United States Patent [19]

Chikatani et al.

[11] Patent Number: 4,617,785

[45] Date of Patent: Oct. 21, 1986

[54] PACKAGING APPARATUS

[75] Inventors: Hajime Chikatani, Hachioji; Sanji Kawakami, Kodaira, both of Japan

[73] Assignee: Kabushiki Kaisha Daisei Kikai, Tokyo, Japan

[21] Appl. No.: 381,307

[22] Filed: May 24, 1982

[30] Foreign Application Priority Data

May 23, 1981 [JP] Japan ..... 56-78307

[51] Int. Cl.[4] ..... B65B 43/04; B65B 43/34

[52] U.S. Cl. ..... 53/562; 53/570

[58] Field of Search ..... 53/455, 562, 570, 459, 53/385, 386, 261, 574, 553

[56] References Cited

U.S. PATENT DOCUMENTS

| | | | |
|---|---|---|---|
| 2,330,361 | 9/1943 | Howard | 53/455 |
| 2,772,530 | 12/1956 | Williams | 53/562 |
| 2,987,857 | 6/1961 | Whelan | 53/455 X |
| 3,359,703 | 12/1967 | Quaadgras | 53/562 X |
| 3,371,461 | 3/1968 | Aronson | 53/455 X |
| 3,975,888 | 8/1976 | Jones | 53/570 X |

*Primary Examiner*—Horace M. Culver

*Attorney, Agent, or Firm*—Oblon, Fisher, Spivak, McClelland & Maier

[57] ABSTRACT

Disclosed is a method and apparatus for forming packages from continuous folded sheets. A sheet is folded and formed into bags by bonding and cutting. Prior to the formation of the bags, plates are introduced between the sheets. The plates are mounted so that they can separate from one another to open the bags after the bags have been fully formed, so that the material can be introduced into the bags. Instead of plates, the elements for opening the bags can be wires, suction elements or blowers.

8 Claims, 15 Drawing Figures

PACKAGING APPARATUS

BACKGROUND OF THE INVENTION

The present invention relates to a packaging apparatus in which plastic films or other sheet materials are put one upon another, and the plastic films so put together are then partially bonded and cut to continuously make bags, and articles to be packaged are charged into these bags.

As shown in FIG. 1, such a conventional apparatus has been so constructed that a sheet material 1' such as plastic film is folded at its center along the longitudinal direction and is put together, for example, by a former 2'. The folded film is then fusion-bonded sideways at given intervals and cut at 3', thereby to continuously make bags 4', and the opening parts of said bag 4' are then manually or mechanically pushed up one by one toward bag-opening blades 5' by a suction means 6' or the like, the bags are conveyed with the bag-opening blades 5' inserted in their opening parts. The blades are separated from each other at a charging position for articles to be packaged, to open the bags, and the articles to be packaged are charged into the bags. Since the thus-made bags of plastic film or the like are difficult to open because of the intimate fitting of their sheets, and since it is difficult to insert the bag-opening blades 5' owing to the difficulty of smoothly performing their opening operation, the conventional apparatus has had defects such as complexity in a mechanism for mechanically effecting a reliable bag-opening operation and blade-inserting operation and further the impossibility of acceleration of these operations.

When a film for making of bags is thin, in particular, it is almost impossible to effect the operation of opening bags and securely putting the blades into them, with various effects such as a requirement of auxiliary installations for preventing the film from being charged with static electricity which makes the opening of bags difficult.

OBJECTS OF THE INVENTION

The present invention is intended to provide a packaging apparatus of the type that is free from such defects as mentioned above, for conventional apparatuses, and that is simple in structure and compact, and able to accelerate operations.

BRIEF DESCRIPTION OF THE DRAWINGS

The apparatus according to the present invention will be described here in accordance with the following drawings.

DETAILED DESCRIPTION OF THE PREFERRED EMBODIMENTS

Figure 1:
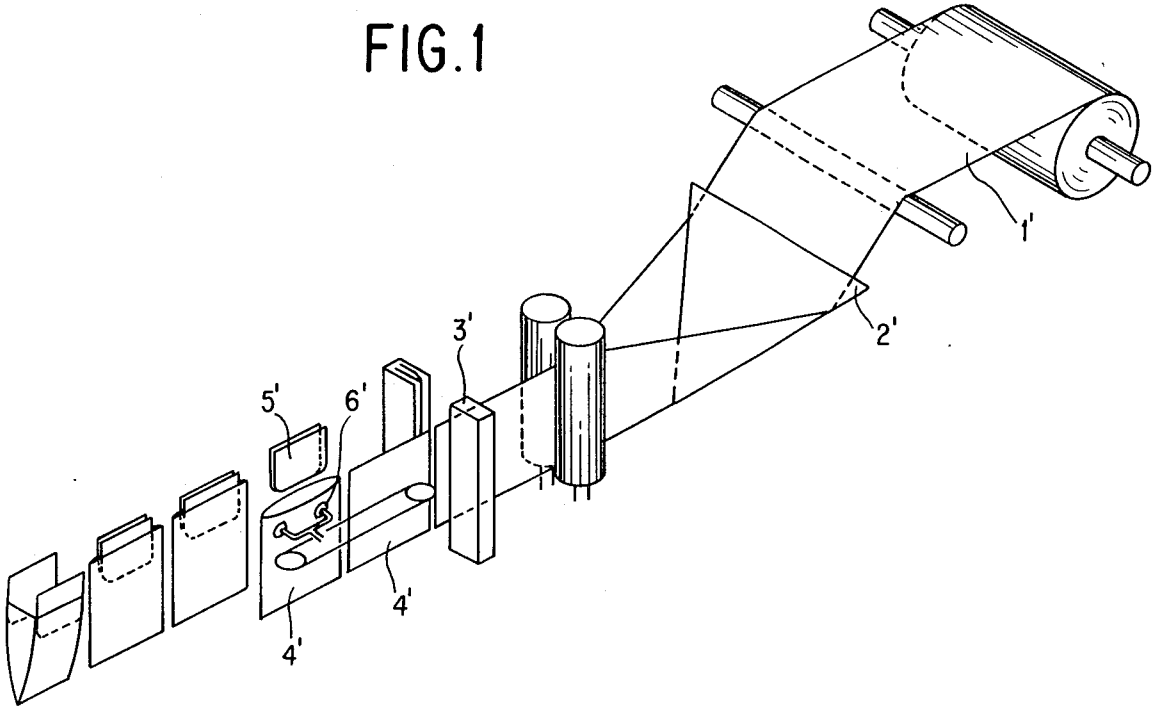
FIG. 1 shows the prior art.
Figure 2:
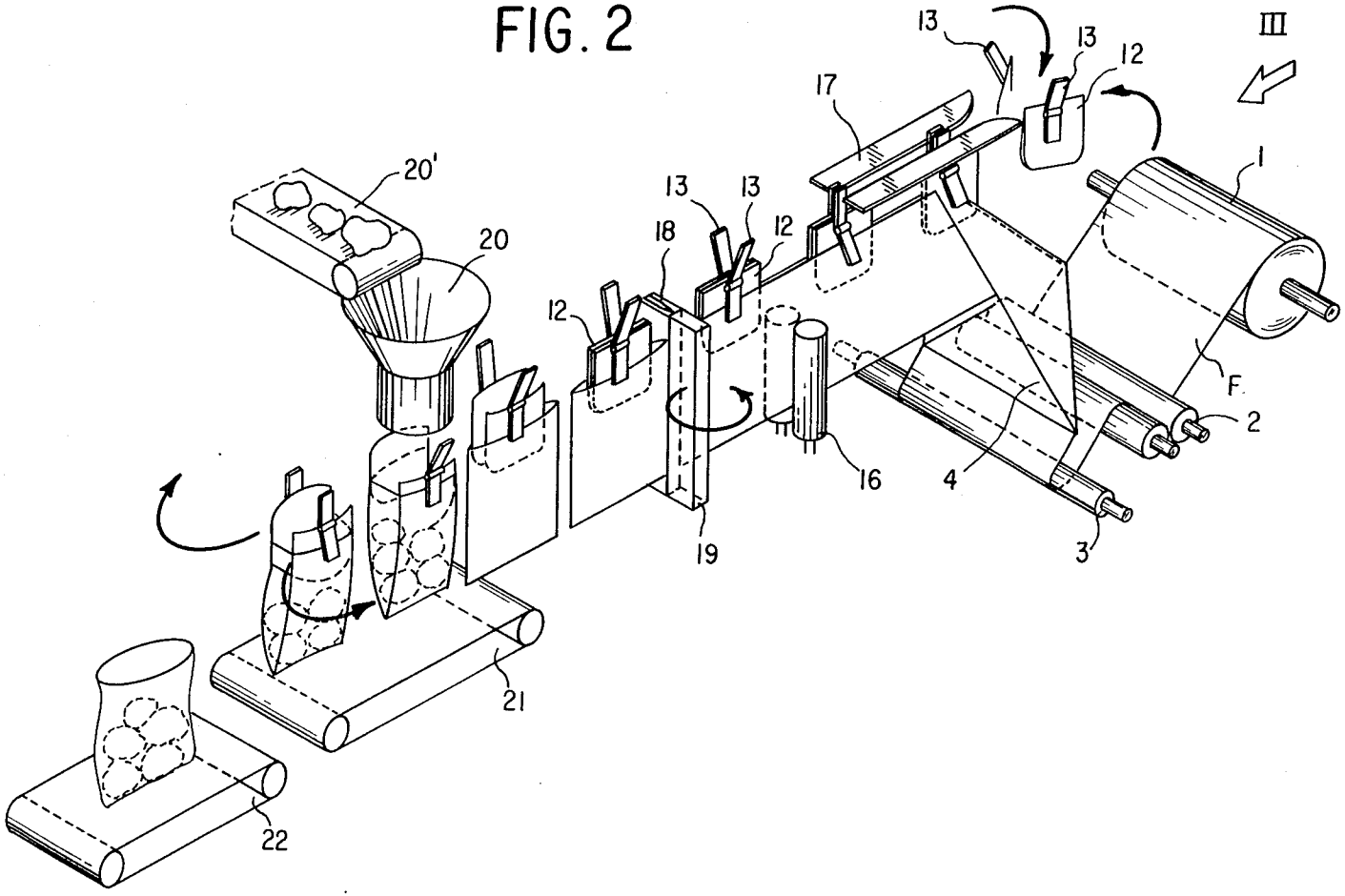
FIG. 2 is a prespective view showing one embodiment of the packaging apparatus according to the present invention.

In FIG. 2, the reference numeral 1 represents a roller drapery of sheet material for making of bags, and a film F rewound from the roller drapery 1 by a film feed roller 2 is fed to a former 4 by way of a guide roller 3 and folded up around its longitudinal center line.

Figure 3:
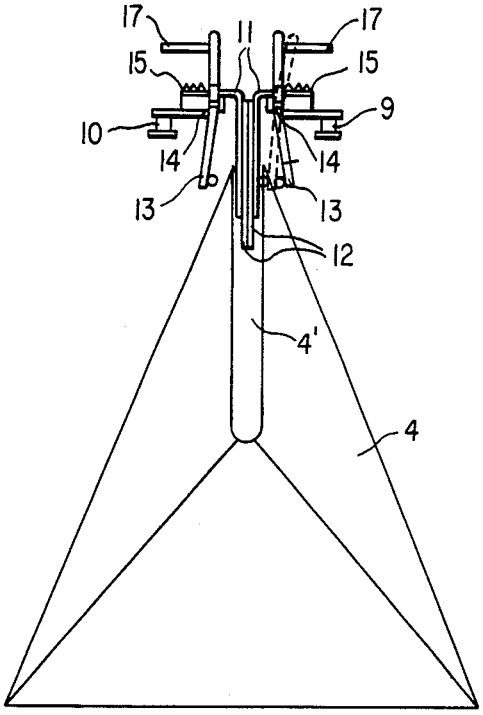
FIG. 3 is a side view showing the former portion of FIG. 2, seen from the direction of the arrow III of FIG. 2.

The former 4 is shaped in the form of a triagonal pyramid, as shown in FIG. 3, and this former 4 is provided with groove 4' formed along one ridge, through which the longitudinally folded film F is passed.

Figure 4:
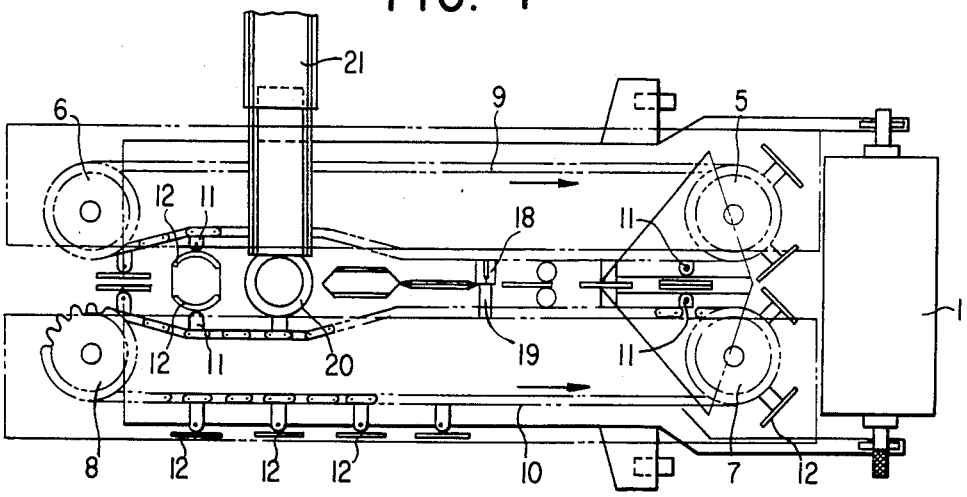
FIG. 4 is a plan view of the apparatus shown in FIG. 2.
Figure 5:
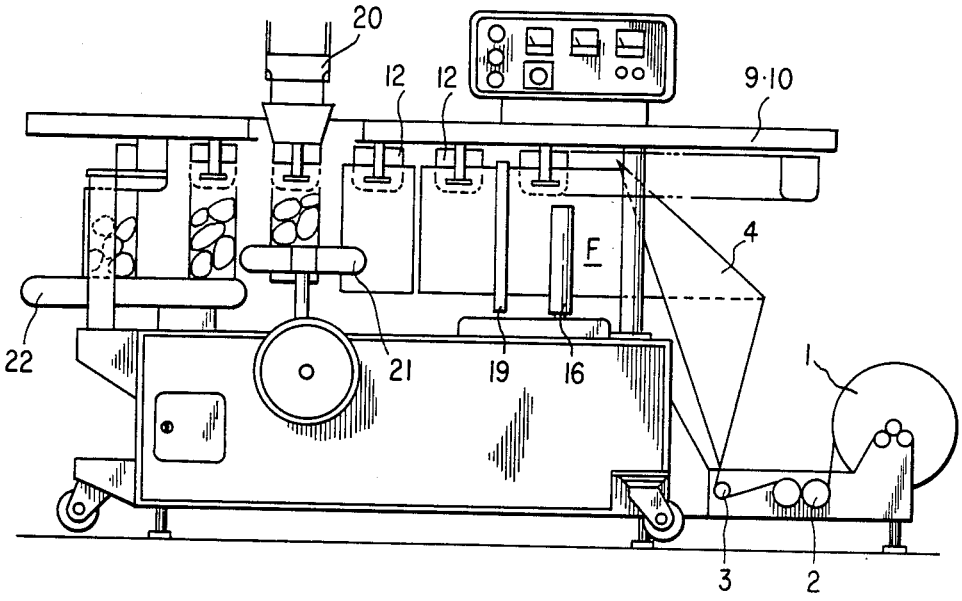
FIG. 5 is a side view thereof.

On the other hand, two pairs of chain wheels 5,6 and 7,8 are arranged above the former 4, as shown in FIG. 4 and FIG. 5, and an endless chain 9,10 is stretched over each pair of the chain wheels 5,6 and 7,8, respectively, and both the chains 9,10 are moved at a speed equal to each other in the direction of the arrows. Both the chains 9,10 are provided with brackets 11 mounted at equal intervals thereon, and a bag-opening blade 12 is fitted on each of said brackets 11.

Each of the brackets is 11 is further provided with a pusher 13 pivotally secured thereon by a pin 14. Each of the pushers 13 has a lower end biased by a tension spring 15 in the direction that it is pressed against the bag-opening blade 12 (FIG. 3). The chains 9,10 are given such a travelling locus that they are caused to travel in parallel with each other in the early portion where they travel closely to each other, but they are later separated from each other, as shown in FIG. 4.

In FIG. 2, the film F passed through the former 4 and folded in two is conveyed to the left in the drawing by film pull rollers 16.

The bag-opening blades 12, conveyed through the groove 4' of the former 4 by the endless chains 9,10 are put between the leaves of the film F which has been twice-folded by the former 4.

Namely, a pair of guide bars 17 are arranged above the former 4, and when the bag-opening blades are conveyed over the former 4 by the endless chains 9,10, the pushers 13 pivotally secured on the brackets 11 are brought in contact with said guide bars 17, so as to be displaced against the tensile force of the spring 15 from the dotted line position of FIG. 3 to the solid line position, whereby the contact of the lower ends of the pushers 13 and the blades 12 is released and only the blades 12 are therefore put between the leaves of the twice-folded film F. When the blades 12 have been further conveyed left by the chains 9,10, the pushers 13 are released from their engagement with the guide bars 17, and the pushers 13 are then returned to the position shown by the dotted line in FIG. 3 so that they grip the twice-folded film F between their lower ends and the blades 12, wherein the twice-folded film F is conveyed left with the conveyance of the blades 12.

A pair of a seal cut bars 18 and a seal cut bar accepter 19 are arranged downstream from the film pull rollers 16, the twice-folded film F gripped between the blades 12 and pushers 13 which is conveyed with the movement of the chains 9,10 is intermittently clamped by the bar 18 and the bar accepter 19, and the twice-folded film F is laterally sealed at given intervals and cut off, thereby to form bags closed in both the sides and the lower end.

The bags thus-cut off are further conveyed left with the movement of the chains 9,10, while they are held by the blades 12 inserted in the bag and the pushers 13 on the outside.

As clearly shown in FIG. 4, the travelling tracks of the chains 9,10 are regulated so that they are separated from each other behind the position where the seal cut bar 18 is arranged, and when the blades 12 mounted on the chains 9,10 by the brackets 11 travel past that position they are separated from each other, and as a result, the blades 12 in the bag open the bag.

A hopper 20 is arranged above the position where the chains 9,10 are separated, and articles to be packed into the bag are conveyed into the hopper 20 by a delivery conveyer 20'.

Figure 6:
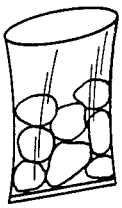
FIG. 6 is a perspective view showing a bag into which articles to be packaged have been charged.
Figure 7:
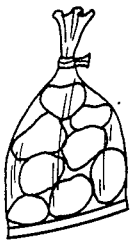
FIG. 7 and FIG. 8 are perspective views showing completed packages.
Figure 8:
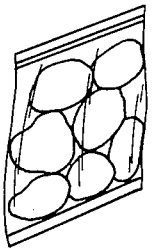

Accordingly, the bag whose opening part is gripped from the inside and outside by the blades 12 and the pushers 13 is opened in its opening part, as it is conveyed, and the articles which are falling from the hopper 20 are charged into the bag at the opened position. A receiving conveyor 21 for preventing the falling of the bag due to the charge of the articles is placed under the hopper 20. The chains 9,10 are thereafter caused to approach to each other again, the pushers 13 contact with bars (not shown) arranged as well as the guide bars 17 to release the gripping of the bag, and the bag filled with the articles is transferred to a secondary receiving conveyor 22 and then sent to a next step of closing the opening part of the bag, or it is discharged in the state shown in Fig. 6 and closed into a sealed package as shown in FIG. 7 or FIG. 8, with its opening part closed manually or by another means.

In the above-mentioned embodiment, a sheet of plastic film 1 is folded in two to make bags with the folded part at their bottom. Instead of this case, however, the same packaging can be effected by another manner comprising putting two separate films one upon another and sealing its bottom part continuously.

Any pusher of proper type other than one shown in the drawings may be used as the pusher 13 for gripping a bag, and a proper mechanism may be also utilized for its gripping and releasing.

There may be used, as the blade 12, a flexible one or flat and rigid one.

Sealing and cutting of both the sides of a bag are carried out at the same time in the embodiment shown in the drawings, but there may be adopted a mechanism comprising first sealing a bag and thereafter cutting it.

In the foregoing, the packaging case has been described which adopts a mechanism of positively removing the pushers 13 from the opening part of a bag after articles are charged thereinto, but an embodiment may be devised in which, when articles have a certain weight, a bag is released from its engagement with the blades 12 and pushers 13 due to their weight so as to fall downwards, and the actuation of such a removing mechanism may be properly decided by choosing the strength of the spring 15 or the like.

In the above embodiment, there has been described the packaging case where a sheet material for making of bags is continuously conveyed. However, another manner may be adopted, as a matter of choice, in which a sheet material is intermittently conveyed, and while its conveyance is stopped, it is fusion bonded and cut to make bags, and articles to be packaged are then charged thereinto.

In the above-mentioned embodiment the bag-opening member composed of two plate-like blades 12 is adopted. However, there may also be adopted a further means which intervenes between the sheet materials put one upon another, and which can open the bags when articles to be packaged are charged therein.

Figure 12:
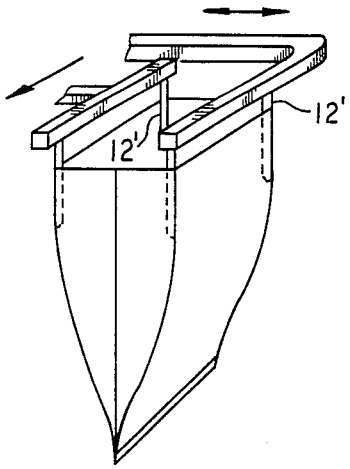
FIGS. 12 to 15 are perspective views showing other embodiment of bag-opening members.

For example, the bag-opening member may be composed of a wire-like member 12' as shown in FIG. 12, that is adapted to open bags as illustrated in the drawings. In the above-mentioned embodiment, furthermore, such a case has been described that a pair of the blades 12 are conveyed by the chains 9,10 and the tracks of the chains 9,10 are determined to open bags by its movement. However, there may be adopted another proper composition in which bag-opening members inserted in a bag are displaced, thereby to open the bag.

Figure 13:
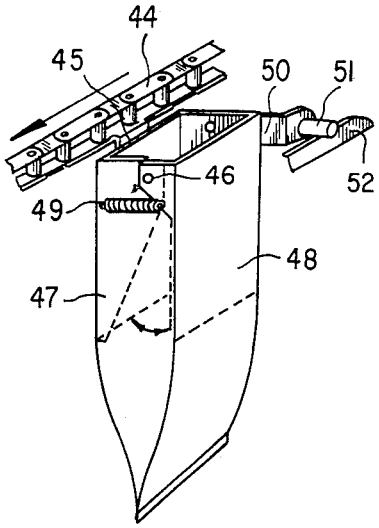

As shown in FIG. 13, for example, only one endless chain 44 is arranged in addition to the chains 9,10 in the above embodiment, brackets 45 are mounted on the same chain at given intervals, and a plate 47 as the bag-opening member has a plate 48 pivotally secured in its upper end by a pin 46 is fitted on each bracket 45.

The plate 48 is pulled toward the plate 47 by a spring 49 and the lower ends of both the plates 47,48 are therefore biased so as to be always closed and put one upon the other.

The bag-opening members shown in FIG. 13 are caused to intervene between the sheet materials during the making of the bags in addition to the blades 12 shown in FIG. 1 to FIG. 5, with the movement of the chain 44, in the state that its lower ends are closed and put one upon the other by means of the biasing force of the spring 49.

On the other hand, a bracket 50 is provided at the upper part of the plate 48 and a contactor 51 is fitted on the bracket 50.

A guide bar 52 is arranged so as to contact with the contactor 51 at the position where a bag is to be opened when articles to be packaged are charged, in addition to the guide bars 17 shown in FIG. 2. When the guide bar 52 and the contactor 51 are brought into contact with each other, the contactor 51 is lifted upwards by the guide bar 52, and by this motion, the plate 48 is turned around the pin 46, with its lower end opened, and thus the state of FIG. 13 is obtained. When the contactor 51 is removed from the guide bar 52, the plates 47 and 48 become closed at the lower ends again by the force of the spring 49.

Figure 14:
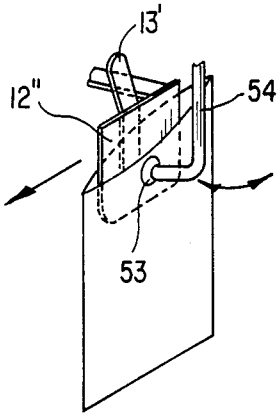

In another bag-opening member shown in FIG. 14, a blade 12'' similar to the blade 12 shown in FIG. 2, fitted to one endless chain (not shown) as well as the bag-opening member shown in FIG. 13, is made to intervene between the sheet materials put one upon the other at the bag-making time, one of the sheet materials put together is gripped by a pusher 13', and a bag is thus made in that state. Opening of a bag separated by cutting and held at one side of its opening part by the blade 12'' and pusher 13' is effected by moving a suction pipe 54 with a sucking disc 53 fitted thereon in the direction of the arrow in the drawings.

Figure 15:
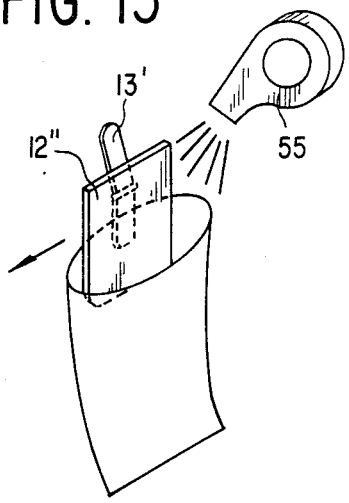

A further bag-opening member shown in FIG. 15 has a blower 55 adapted to blow into and open a bag which is being conveyed, as in the case of FIG. 14.

As concretely illustrated in FIG. 12 to FIG. 15, there may be adopted bag-opening members of various types as the bag-opening member according to the present invention.

Other than the former 4 shown, furthermore, a proper one may be adopted which continuously folds a film in two while the bag-opening members are inserted inside.

Figure 9:
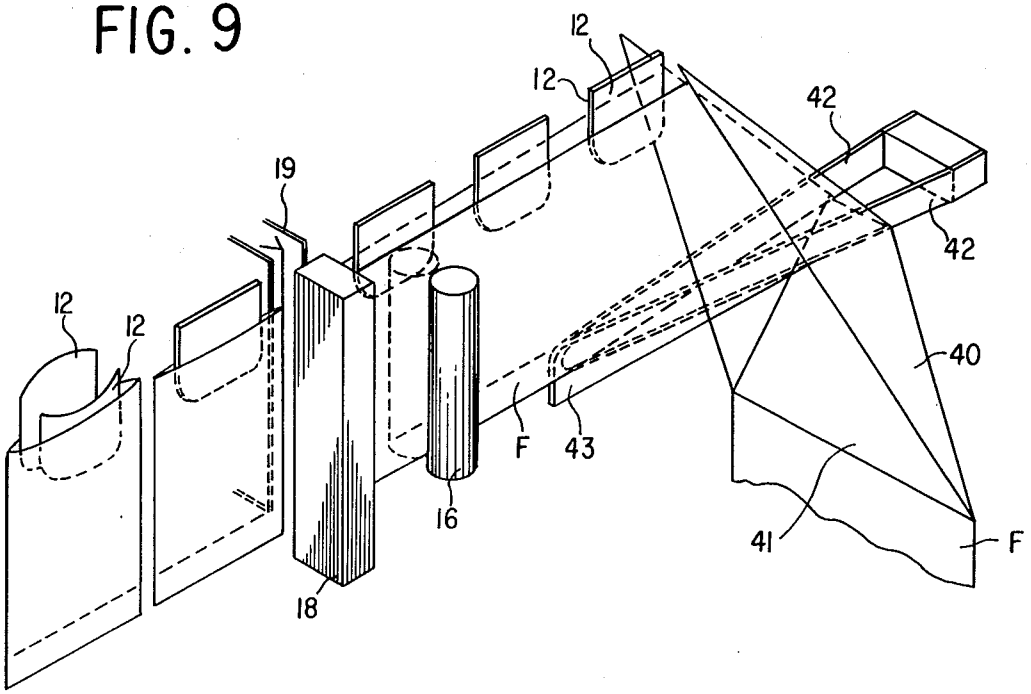
FIG. 9 is a perspective view showing another former which can be adopted in the present invention.

Another former 40 which can be adopted in the present invention is illustrated in FIG. 9.

This former 40 is so shaped that its face 41 to which a film F is being fed is of trapezoid, and two blades 42 are protrudedly provided at a position where the film F is folded up and goes out so that their fore ends are put together as shown in the drawings.

A secondary blade 43 is also protrudedly provided so as to be held at its fore end by the two blades 42 as shown in the drawings.

Figure 10:
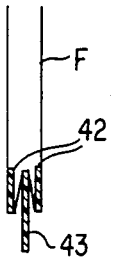
FIG. 10 is a cross-sectional view showing a bag-making operation carried out by the former shown in FIG. 9.
Figure 11:
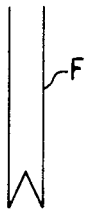
FIG. 11 shows a cross-sectional view of a bag made by using the former of FIG. 9.

The bottom of the film F to be twice-folded is folded by the former 40, as shown in FIG. 10, so that a bag folded at its bottom as shown in FIG. 11 can be formed.

Parts shown in FIG. 9 correspond to those illustrated in the foregoing drawings by the corresponding numerals, which will be omitted in description.

As concretely described in the foregoing, the present invention relates to a packaging apparatus for charging articles to be packaged into bags made by partially bonding sheet materials put one upon another and cutting off them, in which bag-opening members inserted in the opening part of bags to open the bags are made to intervene between the sheet materials put together, while the sheet materials are subjected to the bag-making process. Since bags are manufactured in the state that the bag-opening members are inserted in their opening part, therefore, there is not required such an operation of putting the thus-made bags one by one onto the bag-opening members as in a conventional apparatus.

Accordingly, a packaging apparatus can be made simple and compact, according to the present invention.

Furthermore, it is possible to carry out the working of the machine continuously and extremely smoothly and to accelerate that working, because such an operation of putting bags one by one onto the bag-opening members is not required. Extremely advantageously, it is possible to smoothly effect packaging using a thin film which has been hitherto difficult to handle in a conventional apparatus of this type.

What we claim is:

1. A packaging apparatus comprising:

means for positioning sheet materials next to one another to form at least two facing sheets;

means for bonding portions of said at least two facing sheets;

means for cutting said bonded sheets to form bags;

bag opening means comprising bag opening members, at least one of said bag opening members being mounted for movement between said at least two facing sheets prior to said bonding step;

means associated with said bag opening members for further separating said at least two facing sheets and fully opening said bags after said bonding step; and movable endless chains for movably supporting each of said bag opening members for movement between said at least two facing sheets prior to said bonding step.

2. The packaging apparatus of claim 1 wherein said at least two facing sheets comprise two halves of a folded sheet, and including means for folding said sheet about a longitudinal center line thereof.

3. The packaging apparatus of claim 1 wherein said at least two facing sheets comprise two separate sheet elements.

4. The packaging apparatus of claim 1 wherein said bag opening members comprise pairs of blades.

5. The packaging apparatus of claim 1 wherein said bag opening members comprise pairs of wire-like members.

6. The packaging apparatus of claim 1 wherein said bag opening means comprises a blade constituting said at least one of said bag opening members, and a suction pipe including a suction disc fitted thereon.

7. The packaging apparatus of claim 1 wherein said bag opening means comprises a blade constituting said at least one of said bag opening members, and a blower directed to feed an air jet toward an open end of said bag.

8. The packaging apparatus of claim 1, wherein portions of said endless chains are mutually parallel with one another and wherein said means for fully opening comprise other portions said endless chains where said endless chains mutually separate from one another to separate said opening members from one another.

* * * * *